United States Patent [19]

Alexander et al.

[11] Patent Number: 4,549,473

[45] Date of Patent: Oct. 29, 1985

[54] CHIMNEY CAP

[75] Inventors: Robert L. Alexander, Covington, Ky.; Richard C. Getoor, Madeira, Ohio; Dennis J. Reinersman, Highland Heights, Ky.

[73] Assignee: American Building Components Company, Cincinnati, Ohio

[21] Appl. No.: 624,475

[22] Filed: Jun. 25, 1984

[51] Int. Cl.[4] ..... F23J 13/08

[52] U.S. Cl. ..... 98/67

[58] Field of Search ..... 98/59, 67, 83; 110/119

[56] References Cited

U.S. PATENT DOCUMENTS

| | | | |
|---|---|---|---|
| 1,622,431 | 3/1927 | Feigenbaum | 98/67 |
| 4,334,460 | 6/1982 | Simmons et al. | 98/67 X |
| 4,436,021 | 3/1984 | Hisey | 98/67 |

FOREIGN PATENT DOCUMENTS

| | | | |
|---|---|---|---|
| 64299 | 2/1946 | Denmark | 98/83 |
| 1010301 | 11/1965 | United Kingdom | 98/67 |

*Primary Examiner*—Harold Joyce

*Attorney, Agent, or Firm*—James W. Pearce; Roy F. Schaeperklaus

[57] ABSTRACT

A chimney cap which includes a roof panel, hanger members mounted on the underside of the roof panel and extending downwardly from the roof panel, and an anchor member pivotally mounted on each of the hanger members. The anchor member includes a horizontal flange in flatwise relation with a horizontal flange of an associated hanger member, an upright shank extending downwardly from the horizontal flange member of the anchor, and a plurality of fluke arms extending upwardly and outwardly of the shank. A perforated cage member is mounted under the roof panel and inside the hanger members and engageable by the horizontal flanges of the hanger members to resist upward bending of the horizontal flanges of the hanger members as fluke arms engage the interior of a chimney liner to hold the chimney cap on a chimney.

4 Claims, 5 Drawing Figures

CHIMNEY CAP

BACKGROUND OF THE INVENTION

This invention relates to a cap for a chimney or the like. More particularly, this invention relates to a chimney cap which is adjustable for mounting on chimneys of varying sizes and which can firmly grip a chimney.

Chimney caps of which applicants are aware are shown in U.S. Pat. Nos. 878,811, 926,772, 2,563,710, 2,805,616, 2,976,796 and 4,334,460.

A substantial majority of the chimneys in the U.S. have flues with tile linings of nominally standard sizes, which are of square, rectangular or round cross-section configuration. The smaller and larger cross-section dimensions of the rectangular cross-section tiles respectively correspond to the cross-section dimensions of a nominally small size square tile and a nominally large size square tile, and also correspond to some of the round cross-section flue lining tile diameters as well. While the flue lining tiles are of substantially standard cross sections; that is, may vary ½" or so from the nominal dimensions, the external dimensions of the chimneys vary considerably more.

Also, there has been a trend of change in the marketing of chimney caps in that many of them are now sold through home improvement center type sales outlets and, for the most part, those are installed by home owners themselves. Packaged merchandise in such outlets, chimney caps included, is exposed on shelves or in other manners on the sales floor for selection and pickup by the buyer. Where multiple sizes are required to meet the demands of the trade, correspondingly greater shelf or other display space is needed to display merchandise which meets the trade demands as to size. Chimney caps are relatively bulky and, as a chimney cap of the present invention can be suitable for capping more chimneys, the present invention permits the stocking of one or, at the most, two sizes of caps rather than the many previously needed to meet the trade needs.

Further, the loss of parts presents a substantial problem, particularly where customers can examine the merchandise before purchasing and purchase single units so, unlike a tradesman who installs numerous such devices, they do not have a stock of spare parts to replace any that are lost. The home improvement center type operation similarly carries packaged units as opposed to single parts, so the loss of parts presents problems from several quarters.

One of the objects of the present invention is to provide a chimney cap which is adjustable to cooperate with a variety of sizes of chimney flue linings for mounting purposes and which can be completely assembled at the time of manufacture so that the parts are permanently assembled. This provides assurance against loss of parts and better, more durable assemblies through use of techniques, such as welding, not normally available for use by the do-it-yourself home owner. Further, the fact that a part is missing is more apparent from inspection of the assembled cap than from inspection of a collection of unassembled parts, the single ones of which are usually either in a transparent or opaque bag along with papers bearing instructions.

An object of this invention is to provide a chimney cap which rests on the top of a chimney and which includes anchor members that can fit inside of and engage inner walls of chimney liners of different widths.

BRIEF SUMMARY OF THE INVENTION

Briefly, this invention provides a chimney cap which includes a roof panel and a side wall or cage member of expanded metal underlying the roof panel to form a box into which smoke from a chimney passes to be discharged through openings in the side wall members. Support or hanger members are mounted on the roof panel and extend downwardly to embrace the side wall member. Lower end portions of the support or hanger members extend inwardly below the side wall member and pivotally support anchor members. The anchor members can engage the inside of a liner of the chimney to hold the chimney cap in position on the chimney. The anchor members can pivot between a first position for mounting on a large liner and a second position for mounting on a smaller liner.

The above and other objects and features of the invention will be apparent to those skilled in the art to which this invention pertains from the following detailed description and the drawings, in which:

BRIEF DESCRIPTION OF THE DRAWINGS

In the following detailed description and the drawings, like reference characters indicate like parts.

DESCRIPTION OF PRESENTLY PREFERRED EMBODIMENT

Figure 1:
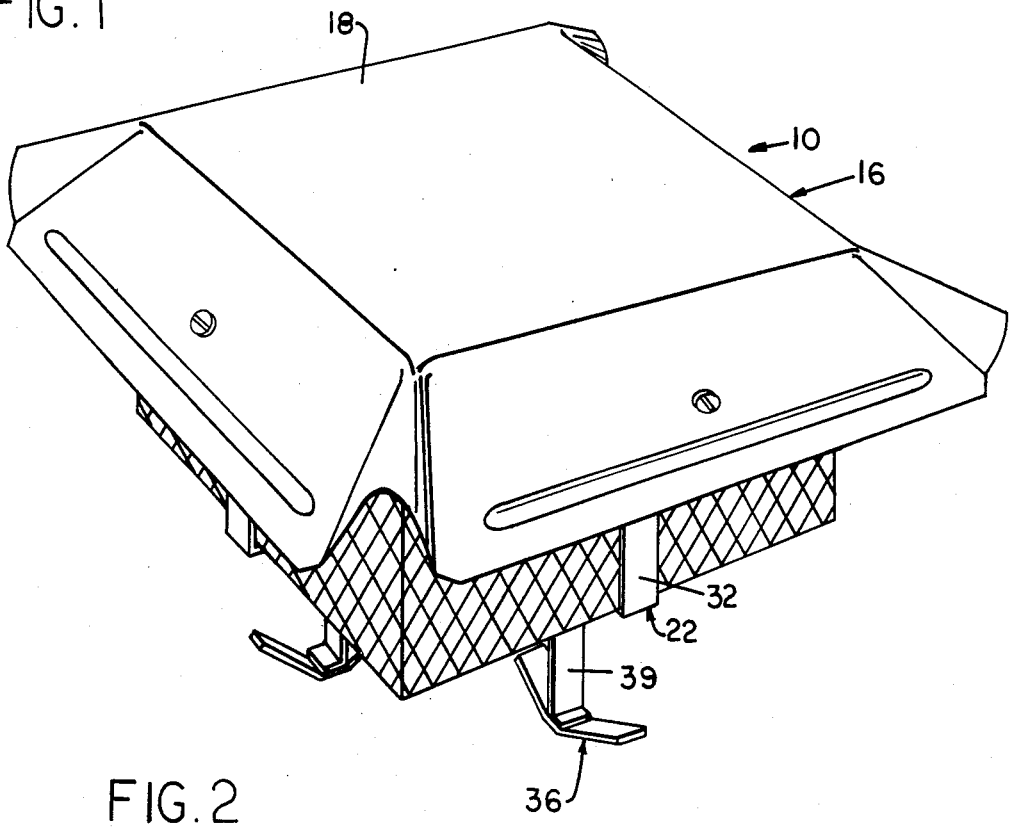
FIG. 1 is a perspective view of a chimney cap constructed in accordance with an embodiment of this invention.
Figure 2:
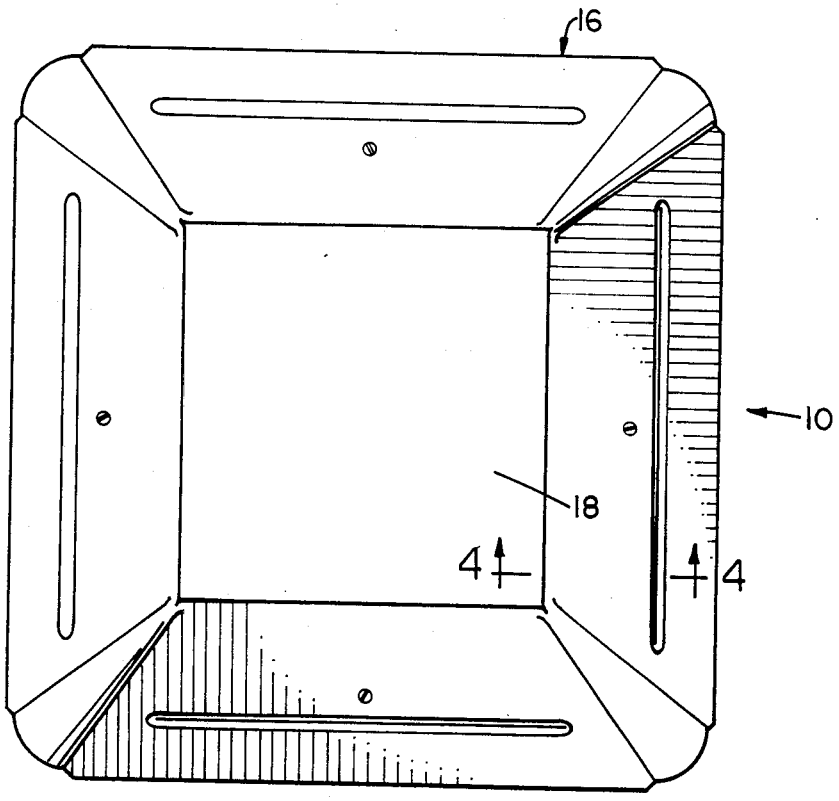
FIG. 2 is a top plan view thereof.
Figure 5:
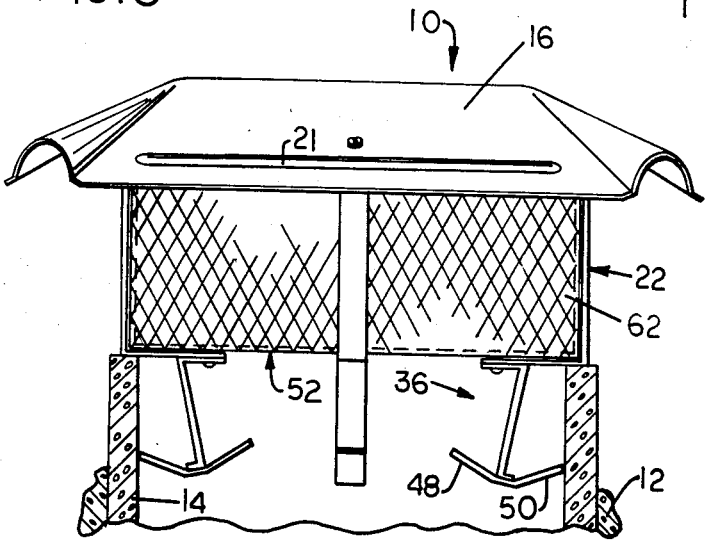
FIG. 5 is a view in side elevation of the chimney cap, a fragmentary portion of a chimney being shown in section in association therewith.

In FIGS. 1–5 is shown a chimney cap 10 constructed in accordance with an embodiment of this invention. In FIG. 5, the chimney cap 10 is shown in association with a fragmentary portion of a chimney 12 having a flue liner 14.

The chimney cap 10 includes a top plate member or cover 16, which includes a flat central panel 18 and sloping panels 20 surrounding the central panel 18. The cover 16 can be made of heat resistant sheet metal. Each of the sloping panels 20 is provided with a strengthening rib 21.

Hanger members 22 are mounted on the underside of the top plate member 16 at the sloping panels 20. Each of the hanger members includes an upper flange 24, which is attached to the underside of one of the sloping panels 20 in flatwise relation therewith by means of a fastener 26, and a nut 28 threaded on the fastener 26. The fastener 28 extends through openings in the associated sloping panel 20 and in the associated upper flange 24 (not shown in detail). The hanger member also includes an upright body bar portion 32 extending downwardly from the upper flange 24 and a lower horizontal flange 34 extending inwardly of the cap 10 from the lower end of the upright body bar portion 32.

An anchor member 36 is rotatably mounted on each hanger member. The anchor member 36 includes an upper horizontal flange 38, which fits flatwise against the underside of the horizontal flange 34 of the associated hanger member 22, an upright bar portion 39 which extends downwardly from the horizontal flange 38, and a fluke member 40. The upper horizontal flange 38 is pivotally connected to the lower horizontal flange 34 of the associated hanger member 22 by means of a pivot rivet 42. A shank (not shown) of the rivet 42 extends through openings (not shown in detail) in the horizontal flanges 34 and 38. A flange 44 at the lower end of the upright bar portion 39 is rigidly attached to a central portion 46 of the fluke member 40. The fluke member 40 includes fluke arms 48 and 50 which extend upwardly and in opposite directions from the flange 44.

Figure 3:
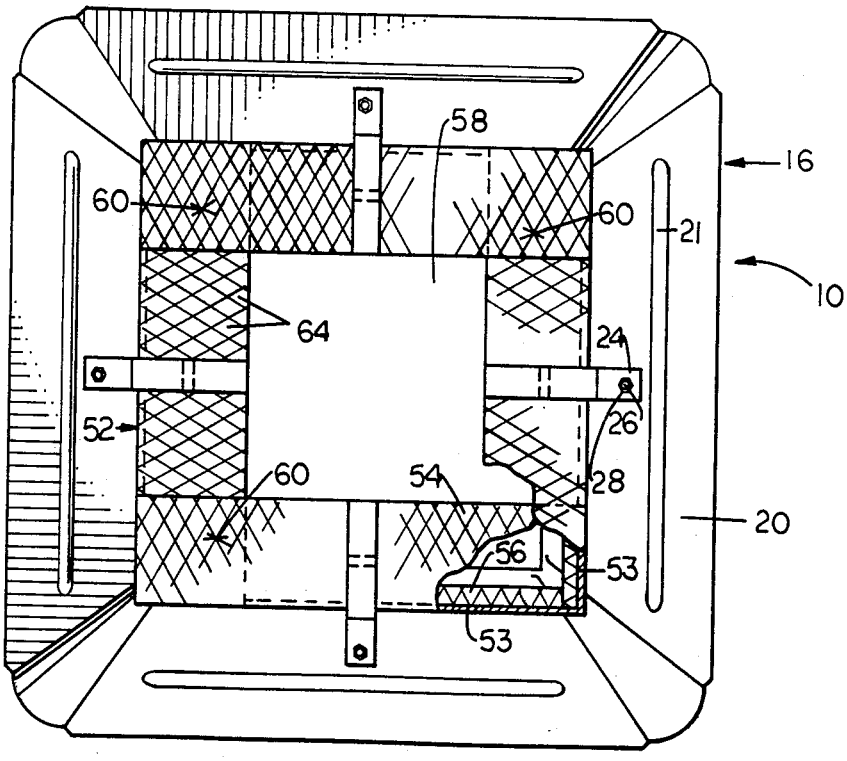
FIG. 3 is a bottom plan view thereof.

A cage member 52, which can be formed of expanded metal or the like, is mounted under the top plate member 16 and inside the hanger members 22. The cage member 52 includes wall panels 53 which are positioned inside the upright bar portions 32 of the hanger members 22, bottom flanges 54, which extend inwardly from lower edges of the wall panels 53 and are supported on the horizontal flanges 34 of the hanger members 22, and upper flanges 56, which fit flatwise against the sloping panels 20 of the top plate member 16. As shown in FIG. 3, portions of bottom flanges 54 overlap adjacent the corners of cage 52 and are secured together as by spot welds 60 to provide increased integrity and dimensional stability to cage 52. The single layer portions of bottom flanges 54 intermediate the overlap portions are thus stiffened by the latter and more firmly cooperate with the lower horizontal flange 34 of hangers 22. The upper flanges 56 can be welded to the sloping panels 20.

Figure 4:
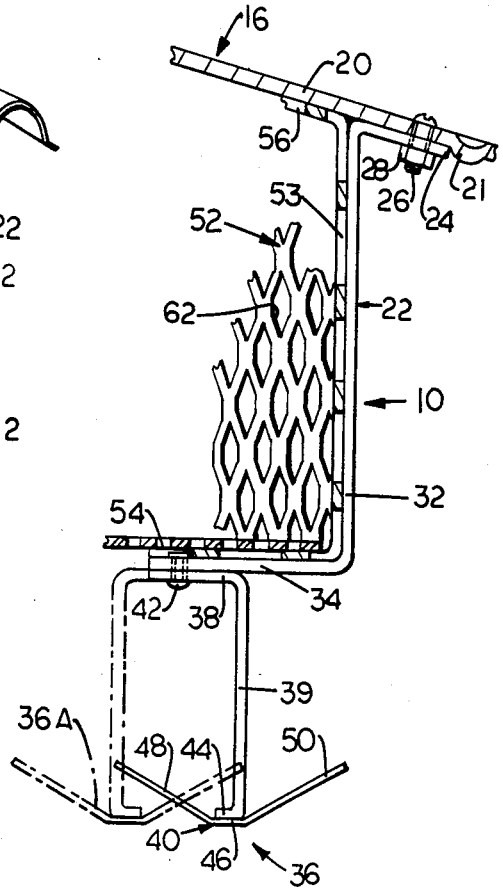
FIG. 4 is a view in section taken on an enlarged scale on the line 4—4 in FIG. 2, a first position of an anchor member being shown in full lines and a second position of the anchor member being shown in dot-dash lines.

As shown in FIG. 5, the chimney cap 10 can be mounted on the upper end of the chimney liner 14 with the anchor members 36 extending inside the liner 14 to grip inner walls of the liner 14. Portions of the horizontal flanges 34 of the hanger members 22 rest on an upper edge of the liner 14. Inner edges of the bottom flanges 54 of the cage member 52 surround an opening 58 through which products of combustion can escape from the chimney 12 into the interior of the cage member 52 to be discharged through openings in the walls of the cage member 52. Resilience of the anchor members 36 holds the fluke arms 50 against the inner walls of the chimney liner 14 when the anchor members 36 are in the full line position of FIGS. 4 and 5. The bottom flanges 54 of the cage member resist upward swinging of the horizontal flanges 34 of the hanger members 22 and pivot rivets 42 secure the horizontal flanges 38 of anchor members 36 so they likewise resist swinging. As shown in FIG. 4, the anchor members 36 can be turned between the full line position and a dot-dash line position 36A. When the anchor members are in the position shown in dot-dash lines in FIG. 4, the anchor members can hold the chimney cap 10 in position on a chimney (not shown) having reduced inner liner dimensions.

Products of combustion rising from the chimney 12 enter the interior of the cage member 52 through the opening 58 and through openings 64 in bottom flanges 54 of the cage and are discharged through openings 62 in the wall panels 53.

The chimney cap illustrated in the drawings and described above is subject to structural modification without departing from the spirit and scope of the appended claims.

Having described our invention, what we claim as new and desire to secure by Letters Patent is:

1. A chimney cap which comprises a roof panel, hanger members mounted on the underside of the roof panel and extending downwardly from the roof panel, each of the hanger members including a body and a horizontal flange mounted on the body and extending inwardly of the roof panel from a lower end of the body of the hanger member, an anchor member mounted on each of the hanger members, the anchor member including a horizontal flange in flatwise relation with the horizontal flange of the associated hanger member, an upright shank extending downwardly from the anchor member horizontal flange, and a fluke arm extending upwardly and outwardly of the shank, and a perforated cage member mounted under the roof panel and inside the hanger members and overlying and engageable by the horizontal flanges of the hanger members to resist upward bending of the hanger member horizontal flange when the fluke arm is in stressed engagement with the interior of a flue liner of a chimney to hold the chimney cap on the chimney.

2. A chimney cap which comprises a roof panel, hanger members mounted on the underside of the roof panel and extending downwardly from the roof panel, each of the hanger members including a body and a horizontal flange mounted on the body and extending inwardly of the roof panel from a lower end of the body of the hanger member, an anchor member mounted on each of the hanger members, and anchor member including a horizontal flange in flatwise relation with the horizontal flange of the associated hanger member, each anchor member horizontal flange being pivotally connected to the associated hanger member horizontal flange, the anchor member including an upright shank extending downwardly from the anchor member horizontal flange and a pair of fluke arms extending upwardly and outwardly from the shank, the anchor member being swingable between a first position at which one of the fluke arms is engageable with an inner wall of a large flue and a second position in which the other of the fluke arms is engageable with an inner wall of a smaller flue, and a perforated cage member mounted under the roof panel and inside the hanger members and engageable by the horizontal flanges of the hanger members to resist upward bending of the hanger member horizontal flanges as the fluke arm engages the interior of a flue liner of a chimney to hold the chimney cap on the chimney.

3. A chimney cap which comprises a roof panel, hanger members mounted on the underside of the roof panel and extending downwardly from the roof panel, each of the hanger members including a body and a horizontal flange mounted on the body and extending inwardly of the roof panel from a lower end of the body of the hanger member, an anchor member mounted on each of the hanger members, the anchor member including a horizontal flange in flatwise relation with the horizontal flange of the associated hanger member, an upright shank extending downwardly from the anchor member horizontal flange, and a fluke arm extending upwardly and outwardly of the shank, and a perforated cage member mounted under the roof panel and inside the hanger members and engageable by the horizontal flanges of the hanger members to resist upward bending of the hanger member horizontal flanges as the fluke arm engages the interior of a flue liner of a chimney to hold the chimney cap on the chimney, the cage member including side walls mounted inside the bodies of the hanger members and horizontal flange portions overlying the horizontal flanges of the hanger members, the horizontal flanges of the hanger members bearing on the horizontal flange portions of the cage member when the fluke arms of the anchor members engage the interior of the flue liner.

4. A chimney cap as in claim 3 in which the cage member includes upper flanges at upper edges of the side walls and means for attaching the upper flanges to the roof panel.

* * * * *

UNITED STATES PATENT AND TRADEMARK OFFICE

CERTIFICATE OF CORRECTION

PATENT NO. : 4,549,473

DATED : October 29, 1985

INVENTOR(S) : Robert L. Alexander, Richard C. Getoor and Dennis J. Reinersman

It is certified that error appears in the above-identified patent and that said Letters Patent are hereby corrected as shown below:

Column 4, Claim 2, line 26, "and" should be — the —.

Signed and Sealed this

*Seventh* Day of *January 1986*

[SEAL]

*Attest:*

DONALD J. QUIGG

*Attesting Officer*

*Commissioner of Patents and Trademarks*